United States Patent [19]

Cornell et al.

[11] Patent Number: 4,811,839

[45] Date of Patent: Mar. 14, 1989

[54] FILM BELT LOADER PACKAGE

[75] Inventors: Lorne T. Cornell, Rochester; Eugene Sisto, Spenceport; Victoria L. Ohtola; Lawrence P. Kenney, both of Rochester, all of N.Y.

[73] Assignee: Eastman Kodak Company, Rochester, N.Y.

[21] Appl. No.: 133,990

[22] Filed: Dec. 17, 1987

[51] Int. Cl.[4] ..... B65D 85/02; G03G 15/00

[52] U.S. Cl. ..... 206/303; 206/493; 242/222; 355/3 BE; 355/3 DR

[58] Field of Search ..... 206/303, 307, 389, 397, 206/53, 408, 54, 413, 493, 415, 416; 355/3 R, 3 BG, 16, 3 CH, 3 DR, 8; 242/222, 147 R

[56] References Cited

U.S. PATENT DOCUMENTS

| | | | |
|---|---|---|---|
| 1,138,434 | 5/1915 | Wilson | 242/222 |
| 1,199,319 | 9/1916 | Thomson | 242/222 |
| 2,432,892 | 12/1947 | Holm | 206/493 |
| 2,506,058 | 5/1950 | Bossmeyer | 206/307 |
| 3,888,577 | 2/1975 | Meyer . | |
| 3,904,040 | 9/1975 | Gilbert | 206/493 |
| 4,380,384 | 4/1983 | Veno et al. | 355/3 CH |
| 4,634,264 | 1/1987 | Takahashi | 355/16 |
| 4,655,578 | 4/1987 | Kurtz et al. . | |
| 4,766,455 | 8/1988 | Carter | 355/3 BE |

*Primary Examiner*—Stephen Marcus
*Assistant Examiner*—Byron Gehman
*Attorney, Agent, or Firm*—Lawrence P. Kessler

[57] ABSTRACT

A film belt package which facilitates loading on support rollers while maintaining the belt protected within the package until loaded on the support rollers. This film belt loader package supports the film belt under tension and in a configuration which substantially replicates its configuration when located on such support rollers. The belt, on its tension support, is enclosed by a member which is adapted to engage such film belt for urging such film belt off of the tension support in order to load such belt on support rollers.

15 Claims, 3 Drawing Sheets

FIG. 5
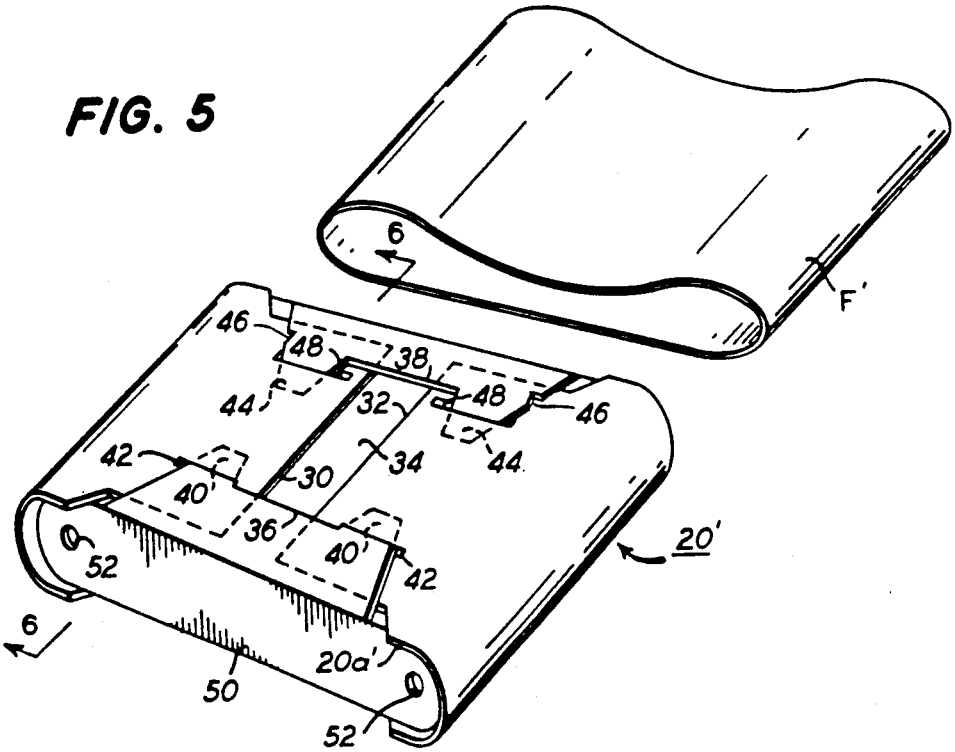
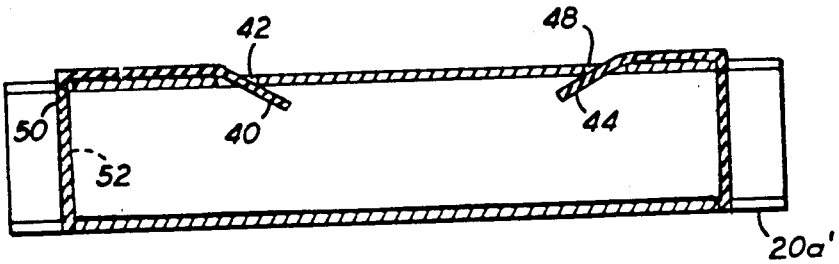
FIG. 6

FILM BELT LOADER PACKAGE

BACKGROUND OF THE INVENTION

This invention relates in general to a film belt package, and more particularly to a film belt package which facilitates loading of the film belt on support rollers without directly touching the film belt.

In electrostatographic reproduction apparatus, for example, it is a general practice to utilize a film belt with a sensitized surface coating. Such film belt is supported within the reproduction apparatus on rollers for transportation about a closed loop path through appropriate process stations. Periodically the film belt must be exchanged for a fresh film belt. In replacing the film belt, care must be taken to prevent touching the film belt either with the hands or structure surrounding the support rollers since such touching can scratch or otherwise damage the sensitized surface of the belt. An example of a package for storing a film belt and loading such belt on support rollers is shown in U.S. Pat. No. 3,888,577 (issued June 10, 1975, in the name of Meyer). The package of this patent requires the use of a separate element for applying tension to the film belt. Such tension must be released prior to loading of the belt onto the support rollers. Further, the packaging must be removed prior to belt loading. This exposes the belt surface to potential damage.

SUMMARY OF THE INVENTION

This invention is directed to a film belt package which facilitates loading on support rollers while maintaining the belt protected within the package until loaded on the support rollers. This film belt loader package supports the film belt under tension and in a configuration which substantially replicates its configuration when located on such support rollers. The belt, on its tension support, is enclosed by a member which is adapted to engage such film belt for urging such film belt off of the tension support in order to load such belt on support rollers.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 5 is a view, in perspective, of an alternate embodiment of the the tensioning support member of film belt loader package according to this invention; and FIG. 6 is a side elevational view, in cross-section, of the tensioning support member taken along lines 6—6 of FIG. 5.

DESCRIPTION OF THE PREFERRED EMBODIMENTS

Figure 1:
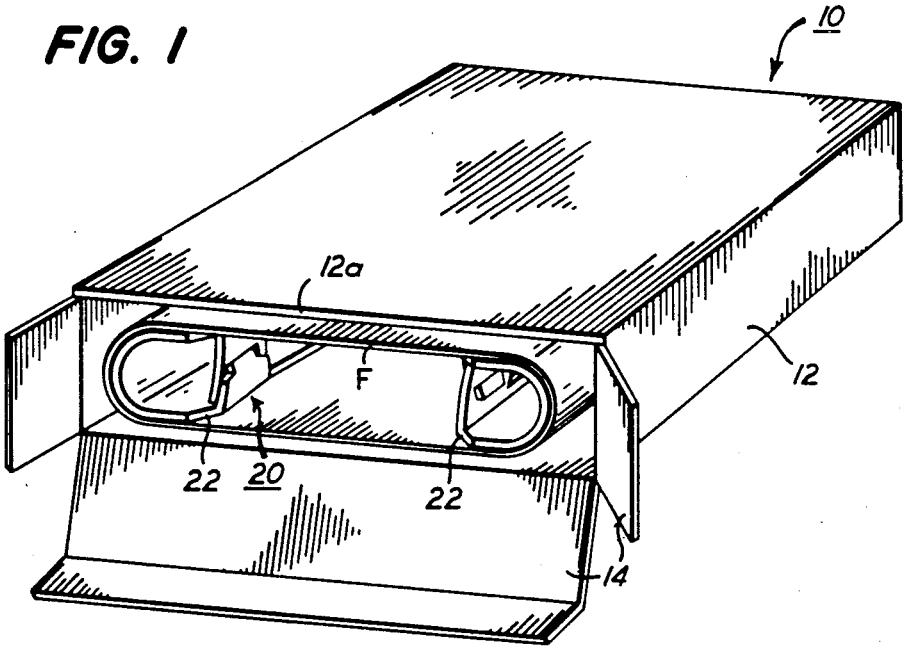
FIG. 1 is a view, in perspective, of the film belt loader package according to this invention.
Figure 3:
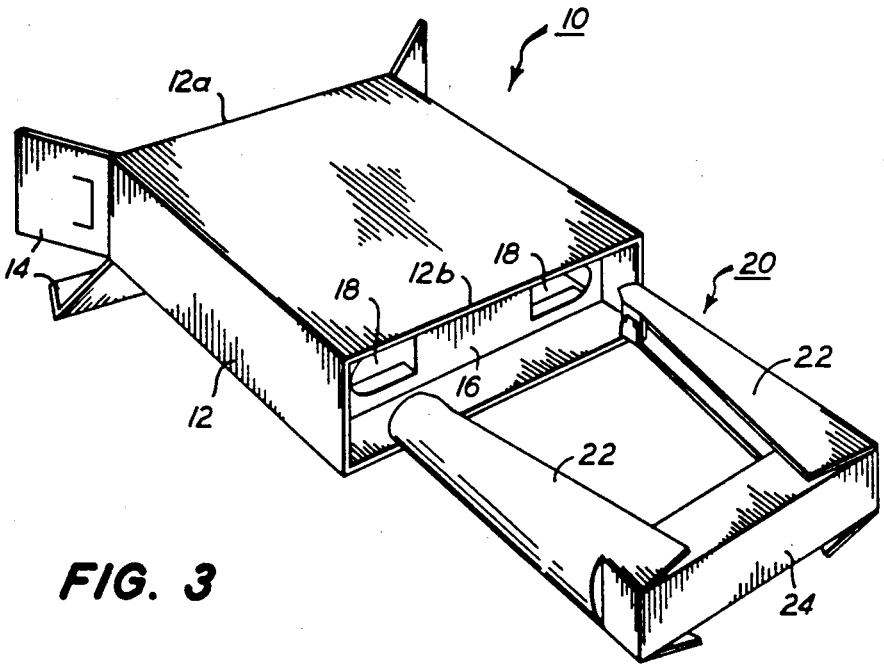
FIG. 3 is an exploded view, in perspective, of the film belt loader package of Fig. 1.
Figure 4:
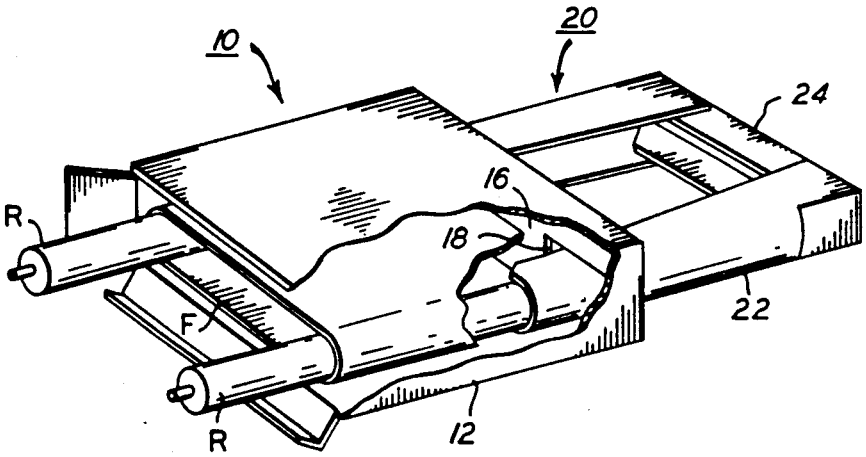
FIG. 4 is a view, in perspective, of the film belt loader package according to this invention, showing the operation for loading a film belt on support rollers, with portions broken away to facilitate viewing.

Referring now to the accompanying drawings, FIGS. 1, 3 and 4 show the film belt loader package, according to this invention, designated generally by the numeral 10. The package 10 includes a film belt encasing outer member 12 and a film belt tensioning support member 20. The support member 20 is adapted to hold a film belt under tension within the outer member 12.

Figure 2:
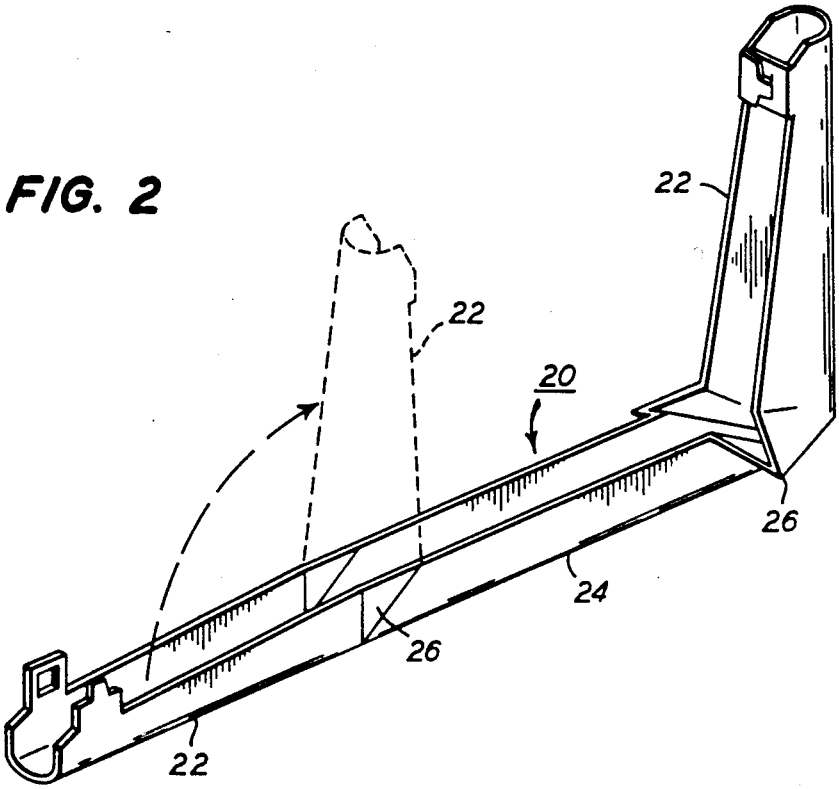
FIG. 2 is a view, in perspective, of the film belt tensioning support of the film belt loader package of FIG. 1, showing the assembly thereof.

The film belt tensioning support member 20 is formed from a planar sheet of relatively stiff material, such as paperboard for example. The material is folded into an arrangement having a pair of arms 22 interconnected by a channel-like web 24. The arms 22 are erected so as to extend at substantially right angles to the web 24 (see Fig. 2), and are configured so as to substantially replicate a roller support for a film belt F. The fold portions 26 of the material forming the transition between the arms 22 and the web 24 urge the arms apart so that the arms form an expandable core. That is, the arms 22 tend to move away from one another in an attempt to return to their unfolded condition. Accordingly, when a film belt F is entrained about the arms 22, the tendency of the arms 22 to move away from one another places the film belt under tension.

The film belt encasing outer member 12 is in the general shape of of a rectangular box. Such member is formed from a planar sheet of material similar to that of member 20 for example. The material is folded into the desired box configuration with end 12a forming standard tuck carton-like closure pieces 14. The opposite end 12b of the member 12 is formed with a recessed sealed closure piece 16. The closure piece 16 has a pair of openings 18 defined therein and adapted to accommodate arms 22 of the support member 20.

When the arms 22 are fully inserted through the openings 18 of the closure piece 16 of the outer member 12, the web 24 of the support member 20 nests in the recess adjacent to the closure piece 16. A film belt F can then be entrained about the arms 22 of the support member 20, and is maintained under tension by the above-described action of the arms. Closing of the pieces 14 of the outer member 12 substantially seals the loader package 10 so that the film belt is fully protected, within the encasing member, from physical damage and undue exposure to light.

The operation for loading of a film belt F from the loader package 10 onto support rollers R is shown in FIG. 4. The tuck carton-like closure pieces 14 of the outer member 12 are opened, and the ends of arms 22 of the tensioning support member 20 are positioned adjacent to, and in substantial alignment with, free ends of the support rollers R. The outer member 12 is then manually urged in a direction to overlie the rollers. As this member moves, the closure piece 16 engages the marginal edge of the belt between the arms 22. Since the arms 22 are prevented from moving by their engagement with the rollers R, the film belt is forced off of the arms and onto the rollers by the piece 16 of the member 12 without any requirement that the belt be contacted by hand. Further, since the outer member 12 remains in its relative location about the surface of the film belt F as the belt is moved onto the rollers, the surface of the belt is protected from potential damage due to unintentional contact of such surface until the belt is fully received on the rollers.

FIGS. 5 and 6 show an alternate embodiment for the film belt tensioning support member 20 of FIGS. 1–4. Such alternate support member, designated generally by the numeral 20′, is formed from a planar sheet of relatively stiff material such as paperboard for example. First opposing marginal edges 30, 32 of the sheet are loosely folded toward one another such that the transverse cross-sectional shape of the sheet generally replicates the shape of a film belt located on support rollers similar to film for the support rollers R, in FIG. 4 with a gap 34 between such marginal edges. Second opposing marginal edges 36, 38 of the sheet are folded transversely to the first opposing marginal edges over the gap 34. Marginal edge 36 has a pair of tabs 40 which are respectively inserted through slots 42 formed in the sheet adjacent to the edges 30, 32 on either side of the gap 34. Marginal edge 38 has a pair of tabs 44 which are tapered and have locking notches 46 formed in the outboard portions thereof. The tabs 44 are respectively receivable in slots 48 formed in the sheet adjacent to the edges 30, 32 on either side of the gap 34.

As the tapered tabs 44 are inserted into the slots 48 of the sheet 20*a*′, they force the opposing marginal edges 30, 32 to move in a direction so as to widen the gap 34. The effect of widening the gap is to cause the member 20′to become an expandable core by expanding the film-supporting portion of the outer perimeter of the sheet. In this manner, a film belt F′ may be readily entrained about the member 20′ and thereafter placed under tension as the tabs 44 are inserted into the slots 48. The member 20′ is held in its tension inducing form when the locking notches 46 are received in the slots 48. After the film belt is entrained about the member 20′, a light tight sheath or bag (not shown) may be placed over a new paper-wrapped film belt to protect the surface of the belt from physical contact or undue light exposure. The bagged film belt on the member 20′ is stored in a box-like structure similar to the member 12 of the embodiment of FIGS. 1–4.

A portion 50 of the sheet forming the member 20′ has a pair of holes 52 defined therein for aligning the member with support rollers (similar to rollers R of FIG. 4). To load the film belt on support rollers, the bagged film belt on the member 20′ is removed from its box-like structure and the light tight sheath. The member 20′ is aligned with the rollers by placing the openings 52 in engagement therewith, and the film belt is urged off of the member and onto the support rollers by pressure applied through the paper wrap on the film belt. The paper wrap is thereafter removed. In this manner the surface of the belt is protected from potential damage due to unintentional contact with such surface until the belt is fully received on the rollers.

The invention has been described in detail with particular reference to preferred embodiments thereof, but it will be understood that variations and modifications can be effected within the spirit and scope of the invention.

We claim:

1. Apparatus for packaging a closed loop film belt and facilitating loading of said film belt on support rollers, said apparatus comprising:

means for supporting a closed loop film belt under tension and in a configuration which substantially replicates its configuration when located on said support rollers; and means for encasing a film belt supported on said support means, said encasing means including means adapted to engage said film belt for urging said film belt off of said supporting means in order to load said film belt on support rollers.

2. The apparatus of claim 1 wherein said supporting means includes an expandable core, and means for aligning said expandable core with support rollers.

3. The apparatus of claim 2 wherein said expandable core includes a pair of arms, and means for interconnecting said arms including a web so that said arms extend substantially perpendicularly from said web and are urged away from one another.

4. The apparatus of claim 3 wherein said arms are integrally formed with said web, and said interconnecting means further including fold portions between said web and said arms respectively.

5. The apparatus of claim 3 wherein said encasing means comprises a substantially rectangular box-like structure including a body portion, a first end closure for said body portion for selectively closing one end of said body portion, and a second end closure for said body portion, said second end closure defining a pair of openings for receiving said arms of said expandable core into the interior of said body portion.

6. The apparatus of claim 5 wherein when a film belt is supported on said pair of arms within said body portion of said box-like structure and said box-like structure is moved relative to said arms, a portion of said second end closure located between the openings thereof engages said film belt and urges the film belt off of said arms.

7. The apparatus of claim 2 wherein said expandable core includes a planar member having a first portion folded into a cross-sectional configuration which substantially replicates the shape of a film belt located on support rollers with a gap defined between opposing marginal edges of such folded first portion, a second portion folded over said gap, and means for interrelating said second portion with said first portion so that movement of said second portion expands the cross-sectional configuration of said first portion.

8. The apparatus of claim 7 wherein said interrelating means includes a tapered tab on said second portion and a slot defined in said first portion, said slot being adapted to receive said tapered tab of said second portion.

9. The apparatus of claim 8 wherein said tapered tab includes a locking notch defined in a marginal edge thereof so that when said locking notch engages an edge of said slot said second portion is locked in position relative to said first portion.

10. A closed loop film belt loader package for storing a film belt and facilitating loading of said film belt on support rollers, said loader package comprising:

a one piece core construction having first means for supporting a film belt in a configuration which substantially replicates the configuration of said film belt when located on said support rollers, and second means for placing a film belt supported on said first means under tension; and means for encasing a film belt supported on said one piece core construction.

11. The apparatus of claim 10 wherein said first means of said one piece core construction includes a pair of arms, and said second means of said one piece core construction includes a web having fold portions at the opposite ends thereof, said fold portions being integral with said arms respectively to locate said arms substantially perpendicularly to said web and urge said arms away from one another.

12. The apparatus of claim 11 wherein said encasing means comprises a substantially rectangular box-like structure including a body portion, end closures for said body portion for selectively closing the ends of said body portion, and one of said end closures defining a pair of openings for receiving said arms of said one piece core construction into the interior of said body portion, whereby when a film belt is supported on said pair of arms within said body portion of said box-like structure and said box-like structure is moved relative to said arms, a portion of said one end closure located between the openings thereof engages such film belt and urges the film belt off of said arms.

13. The apparatus of claim 10 wherein said one piece core construction includes a planar member having a first portion folded into a cross-sectional configuration which substantially replicates the shape of a film belt located on support rollers with a gap defined between opposing marginal edges of such folded first portion, a second portion folded over said gap, a tapered tab on said second portion and a slot defined in said first portion, said slot being adapted to receive said tapered tab of said second portion so that movement of said second portion expands the cross-sectional configuration of said first portion, said tapered tab including a locking notch defined in a marginal edge thereof whereby, when said locking notch engages an edge of said slot, said second portion is locked in position relative to said first portion.

14. The apparatus of claim 13 wherein said encasing means includes a wrap over said film belt, said wrap being engageable to urge said film belt off said one piece core construction in order to load said film belt on support rollers.

15. Apparatus for packaging a closed loop film belt and facilitating loading of said film belt on support rollers in a printer or copier or the like, said apparatus comprising:

a one piece core having a pair of arms, for receiving said film belt, and a connecting member, said core having been formed by folding a single elongated straight piece into said arms and said connecting member with said arm having a natural tendency to return to their original straight condition thereby imparting tension to said film belt; and means engageable with an edge of said film belt and movable relative to said one piece core for removing said film belt from said core to said rollers.

* * * * *